US010010776B2

(12) United States Patent
Gravel et al.

(10) Patent No.: US 10,010,776 B2
(45) Date of Patent: Jul. 3, 2018

(54) CLAMPING ASSEMBLY FOR AN AUXILIARY ROLLER ASSEMBLY FOR A SPORTS GOAL

(71) Applicants: James H. Gravel, The Villages, FL (US); James Ritchie, Jr., Brewster, MA (US)

(72) Inventors: James H. Gravel, The Villages, FL (US); James Ritchie, Jr., Brewster, MA (US)

( * ) Notice: Subject to any disclaimer, the term of this patent is extended or adjusted under 35 U.S.C. 154(b) by 0 days.

(21) Appl. No.: 15/405,842

(22) Filed: Jan. 13, 2017

(65) Prior Publication Data

US 2017/0209757 A1 Jul. 27, 2017

Related U.S. Application Data

(63) Continuation-in-part of application No. 14/795,047, filed on Jul. 9, 2015, now Pat. No. 9,889,365.

(51) Int. Cl.
*A63B 63/00* (2006.01)

(52) U.S. Cl.
CPC ..... *A63B 63/004* (2013.01)

(58) Field of Classification Search
CPC ..... A63B 71/0036; A63B 63/004; A63B 2071/026; A63B 2071/025
See application file for complete search history.

(56) References Cited

U.S. PATENT DOCUMENTS 4,389,047 A * 6/1983 Hall ..... A63B 21/0054 482/2
8,905,872 B2 * 12/2014 Ennis ..... A63B 63/004 273/400
2014/0169922 A1 * 6/2014 Cozza ..... B62B 3/0625 414/495

* cited by examiner

*Primary Examiner* — Gene Kim
*Assistant Examiner* — Jeffrey Vanderveen
(74) *Attorney, Agent, or Firm* — John M. Brandt

(57) ABSTRACT

An improved auxiliary weighted roller assembly attachable to a sports goal ground crossbar to stabilize the goal and to facilitate temporary or long term relocation for field maintenance, alternative field use, or storage consisting of a framework attachable to the crossbar and a pair of weighted rollers attached to the framework one each disposed on the front and rear of the crossbar of sufficient diameter to raise the crossbar above the ground, the improvement comprising devices to increase the strength of the clamping mechanism employed to attach the roller assembly and the goal ground crossbar.

1 Claim, 10 Drawing Sheets

CLAMPING ASSEMBLY FOR AN AUXILIARY ROLLER ASSEMBLY FOR A SPORTS GOAL

CROSS REFERENCE TO RELATED APPLICATIONS

This application is based on the disclosure of U.S. provisional patent application 62/286,494 by the same inventor filed Jan. 25, 2016 which is hereby incorporated by reference, and is a continuation-in-part of U.S. utility patent application Ser. No. 14/795,047 by the same inventors filed Jul. 9, 2015.

BACKGROUND OF THE INVENTION

1. Field of the Invention

The invention resides in field of sports goals and more particularly relates to goals for outdoor use having a framework for supporting a net and further to devices pertaining to preventing such goals from tipping over or shifting position due to high wind, player impact, or inappropriate use by unauthorized use by others.

2. Description of the Prior Art

There is great concern for the stability of sports goals for use on outdoor playing fields for sports such as soccer, field hockey, and the like, and the prevention of injury from accidental or inappropriate use of such goals particularly as they are often unattended due to their public locations. At the same time, it is necessary to occasionally move such goals for field maintenance, long term storage, or alternative field use.

A number of solutions have been proposed including stakes, augers, and portable sandbags as weights all of which are easily tampered with when the goals are unsupervised. A weighted ground crossbar mounted roller system is disclosed in U.S. Pat. No. 8,579,736, Gravel, which, while addressing the problems of stability and mobility is not easily incorporated into existing goals having a wide variety of ground crossbars as are being currently or previously manufactured. The present invention presents a system which is capable of being attached to wide variety of goals for the above stated purposes and is easy to install but not remove or misplace as are most of the prior art devices known to the inventors.

SUMMARY OF THE INVENTION

The invention may be summarized as an auxiliary roller apparatus for a sports goal attachable to a rear ground crossbar disposed between two spaced apart side structures arranged to support a net for trapping a game ball or puck, the apparatus consisting of a frame assembly arranged to position and secure a pair of weighted rollers, one forward of, one rearward of, and substantially parallel to the ground crossbar.

The apparatus functions to provide a substantial counter weight to any forces which may result in the goal shifting or tipping such as strong winds, player contact, or inappropriate use by one or more individuals, for example, hanging from a front or side component of the structure.

The apparatus is designed to allow the goal to be easily moved for temporary or long term relocation for field maintenance, alternative field use, or off season storage. It is optionally configured to be attachable to a standard range of sizes and shapes of cross bars, round, square, and oval, without altering the cross bars; to allow lifting the front of the goal for repositioning without lifting the weight of the forward roller; and further to provide a latitude of stearability during repositioning to maneuver the goal into positions difficult to reach. A recessed port disposed on the longitudinal surface of the rollers for filling the rollers with ballast, sand for example, is also disclosed.

The improvement described herein is arranged to more efficiently insure the secure clamping of the auxiliary roller apparatus to the rear ground crossbar by providing an additional assembly to lock the roller and crossbar together using improved structures to further force or bind components of the two units together.

These and other features and advantages of the invention will become clearer from the description of the preferred embodiments taken with the drawings which follows.

DESCRIPTION OF THE PREFERRED EMBODIMENTS

Figure 1:
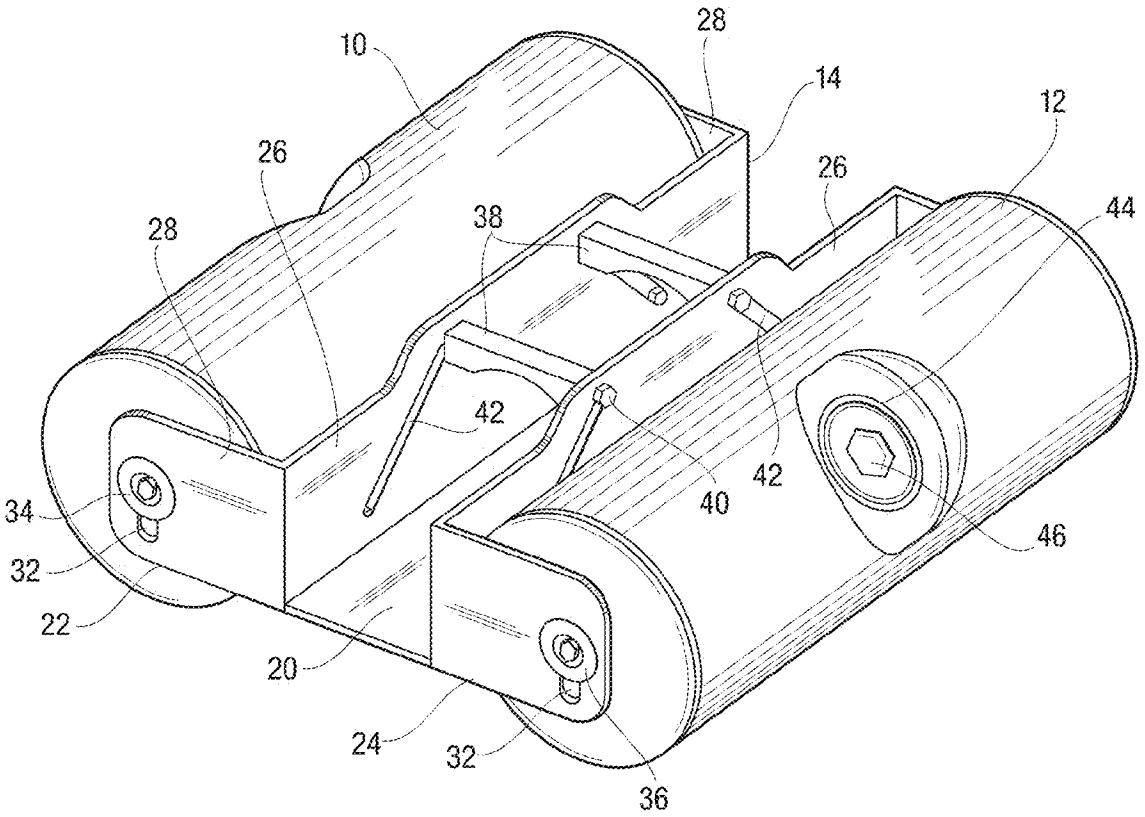
FIG. 1 is a perspective view of the preferred embodiment of the invention.
Figure 2:
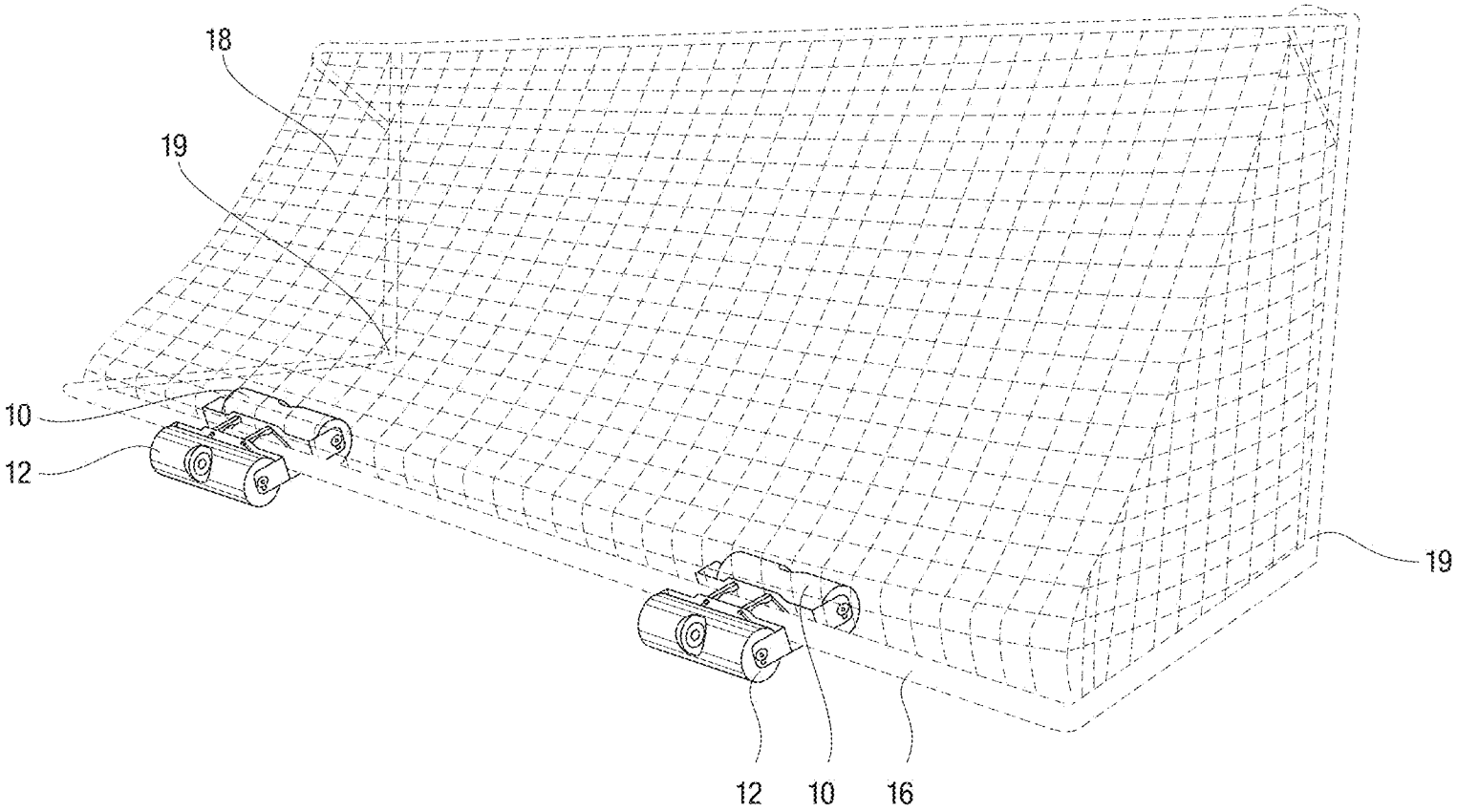
FIG. 2 is a perspective view of the embodiment of FIG. 1 installed on a sports goal.

Referring first to FIG. 1, a perspective view of the preferred embodiment is illustrated in which front hollow roller 10 and rear hollow roller 12 are mounted on frame 14. The assembly as shown is symmetrical allowing for a reverse or 180 degree rotation in positioning the apparatus on a rear ground crossbar 16 of a goal 18 which mounting is shown in FIG. 2.

Frame 14 consists of a central bottom plate 20 joining two spaced apart front and rear roller mounting brackets 22 and 24. As further shown in Figs, 4-6, each bracket is composed of a vertical longitudinal upright 26 and a pair of two side uprights 28 disposed one each at opposite ends of upright 26.

Figure 3:
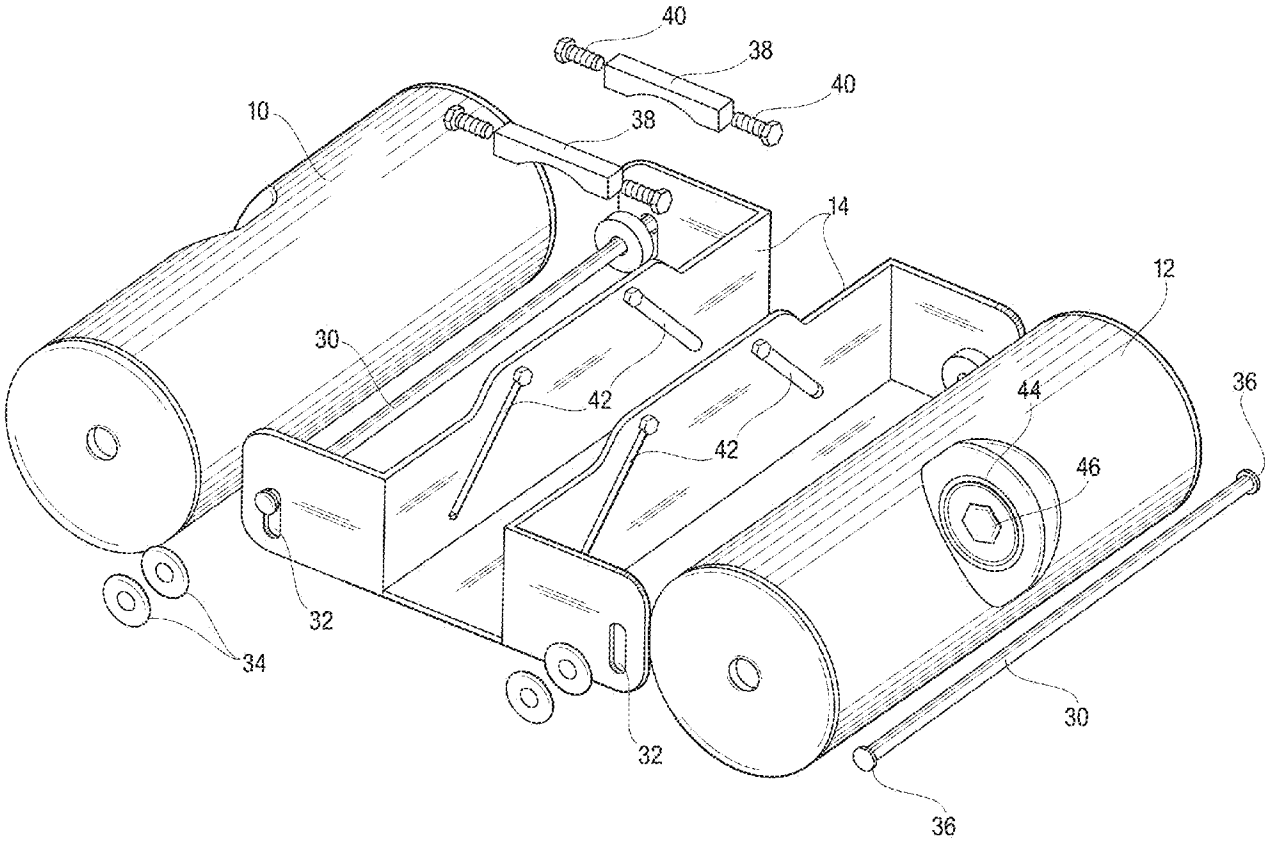
FIG. 3 is an exploded view of the embodiment of FIG. 1.

Each pair of uprights 28 provides a mounting support for a roller axel 30 longitudinally disposed substantially parallel to upright 26 as further illustrated in the exploded view of FIG. 3. Each axel 30 is slideably mounted between a matching pair of side uprights 28 in substantially vertical slots 32 disposed therein and secured thereto by a suitable combination of inside and outside washers 34 on each side of uprights 28 and a ROTORCLIP TX-50 shaft ring 36 or similar device connected to each end of the axel.

Each roller is therefore, with respect to the ground crossbar, free to rotate about a parallel longitudinal axis to that of the crossbar and further to move up and down vertically within the confines of the upper and lower ends of slots 32. This provides the benefit of the front 19 of the goal to be raised a slight amount above the ground to facilitate a moving operation with out raising either of the rollers and their commensurate weight off the ground as well.

Figure 4:
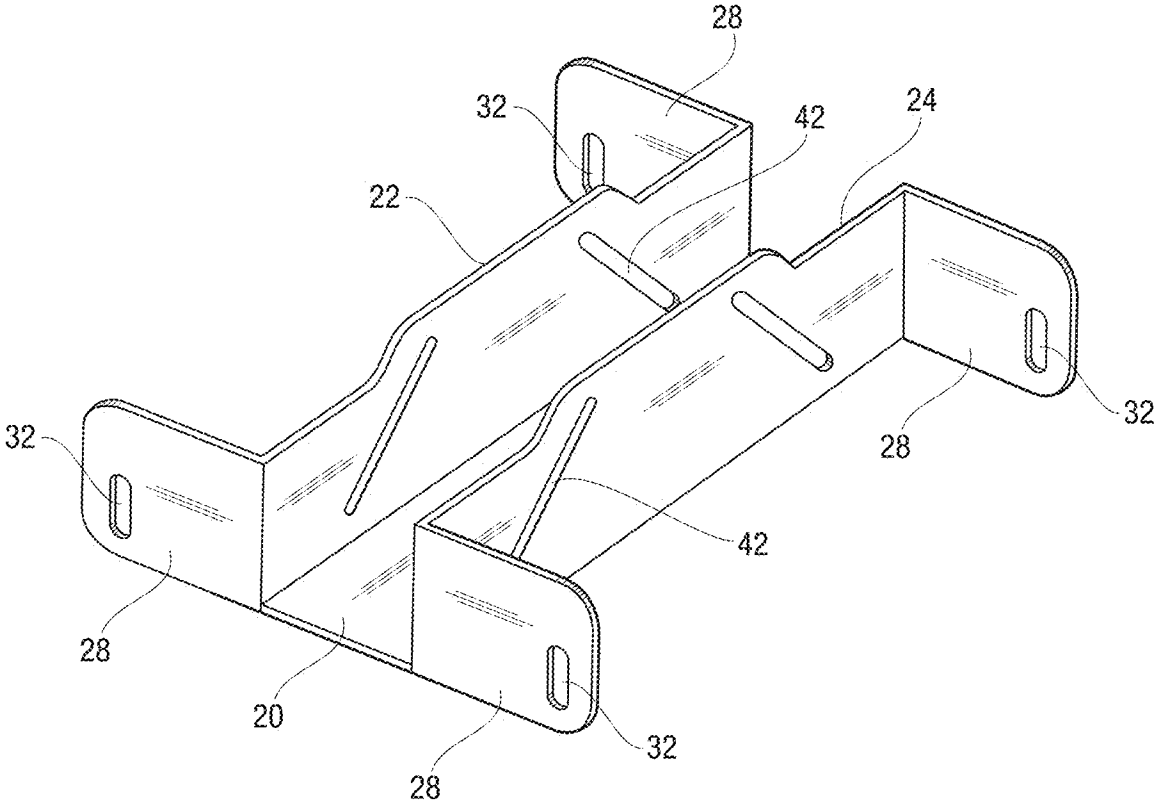
FIG. 4 is a perspective view of one element of the embodiment of FIG. 1.
Figure 5:
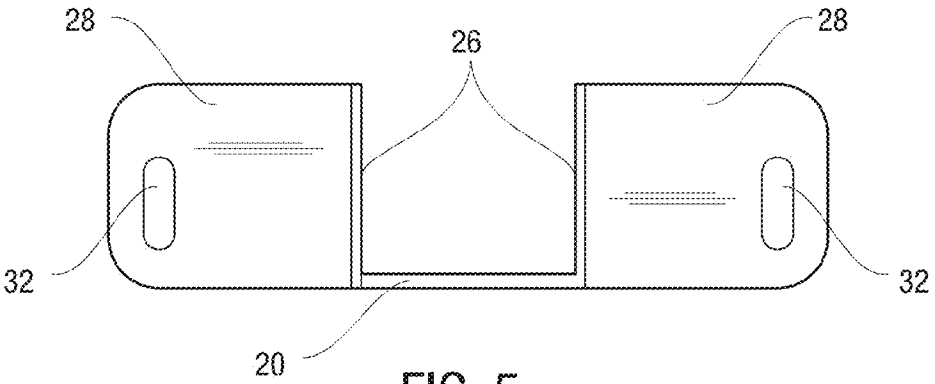
FIG. 5 is a side view of the element of FIG. 4.
Figure 6:
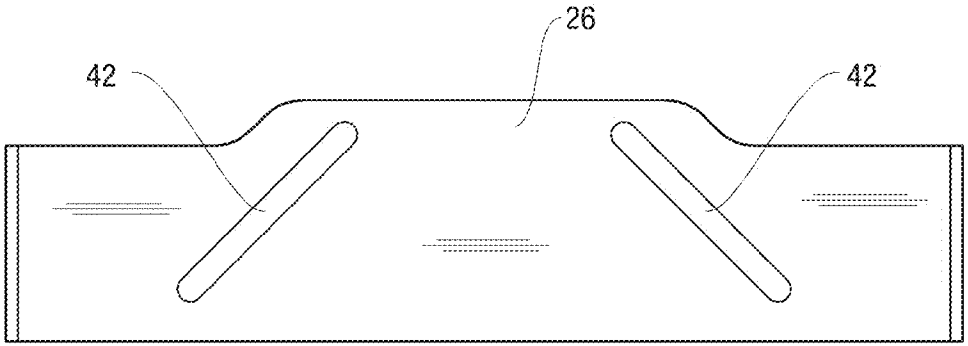
FIG. 6 is a rear view of the element of FIG. 4.
Figures 7, 8:
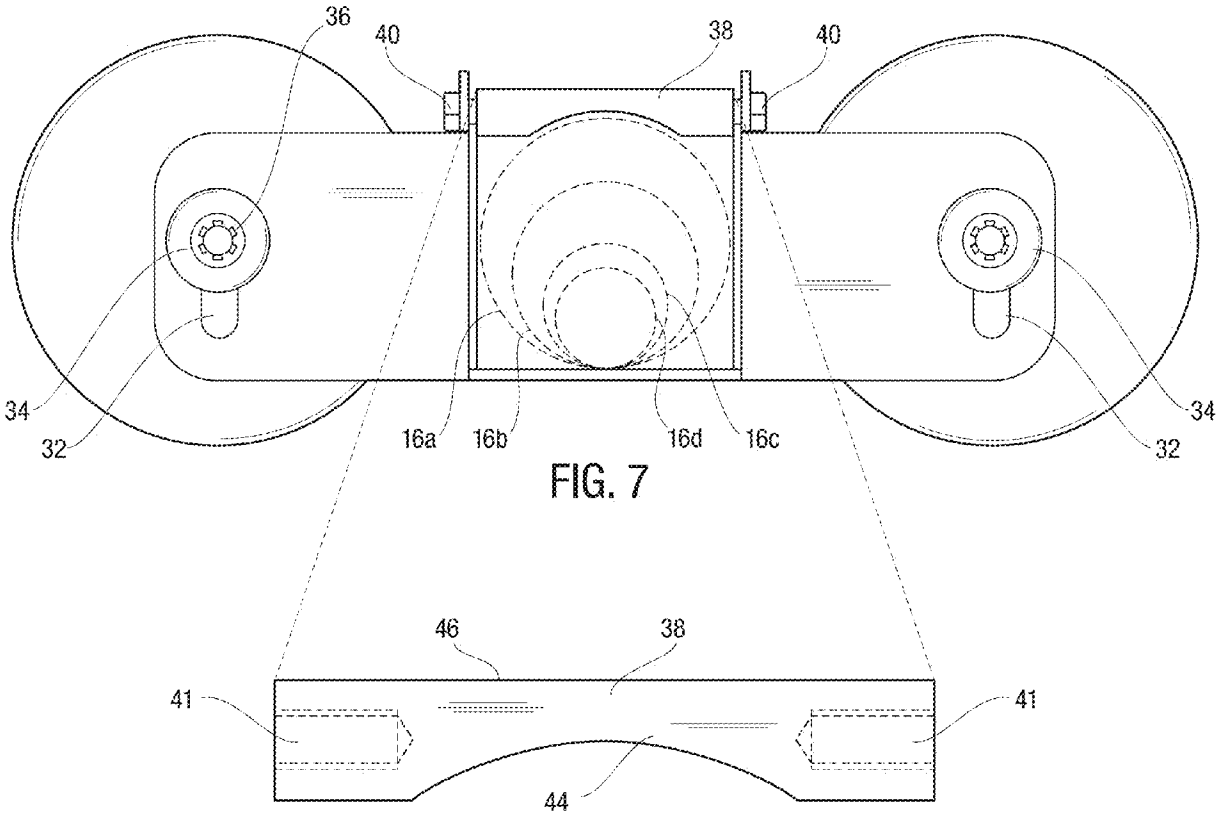
FIG. 7 is a side view of the embodiment of FIG. 1 illustrating alternative installation options of the invention.
FIG. 8 is a side cross-sectional view of an additional element of the embodiment of FIG. 1.

Bottom plate 20 and the front and rear vertical longitudinal uprights 26 comprise in combination a cradle for receiving ground crossbar 16 as shown in FIGS. 2 and 7. As is illustrated, the assemblies are best employed in spaced apart pairs, one near each side of the goal The crossbar is secured in the cradle by downward clamping pressure provided by a pair of longitudinally opposed clamping members 38 secured by side bolts 40. Slots 42 disposed in uprights 26 provide in combination a set of tracks for bolts 40 which when loose allow clamping member 38 to move up and down into various positions. Clamping members 38 have a curved side 44 and a flat side 46 which, upon rotation, provide appropriate contact with either a flat ground crossbar, or a round or oval crossbar of varying size (16*a*-16*d* as shown in FIG. 4) up to the width of bottom plate 20. When a clamping member 38 is secured firmly in place by bolts 40 atop a ground crossbar resting on bottom plate 20, the entire assembly of frame 14 and rollers 10 and 12 is secured to the goal.

Hollow rollers 10 and 12 require ballast in order to sufficiently weigh down the goal and such may be provided by sand, for example, deposited to the interior of both rollers through ports 44 disposed in the curved surface of the roller and closed by threaded caps 46.

Figure 9:
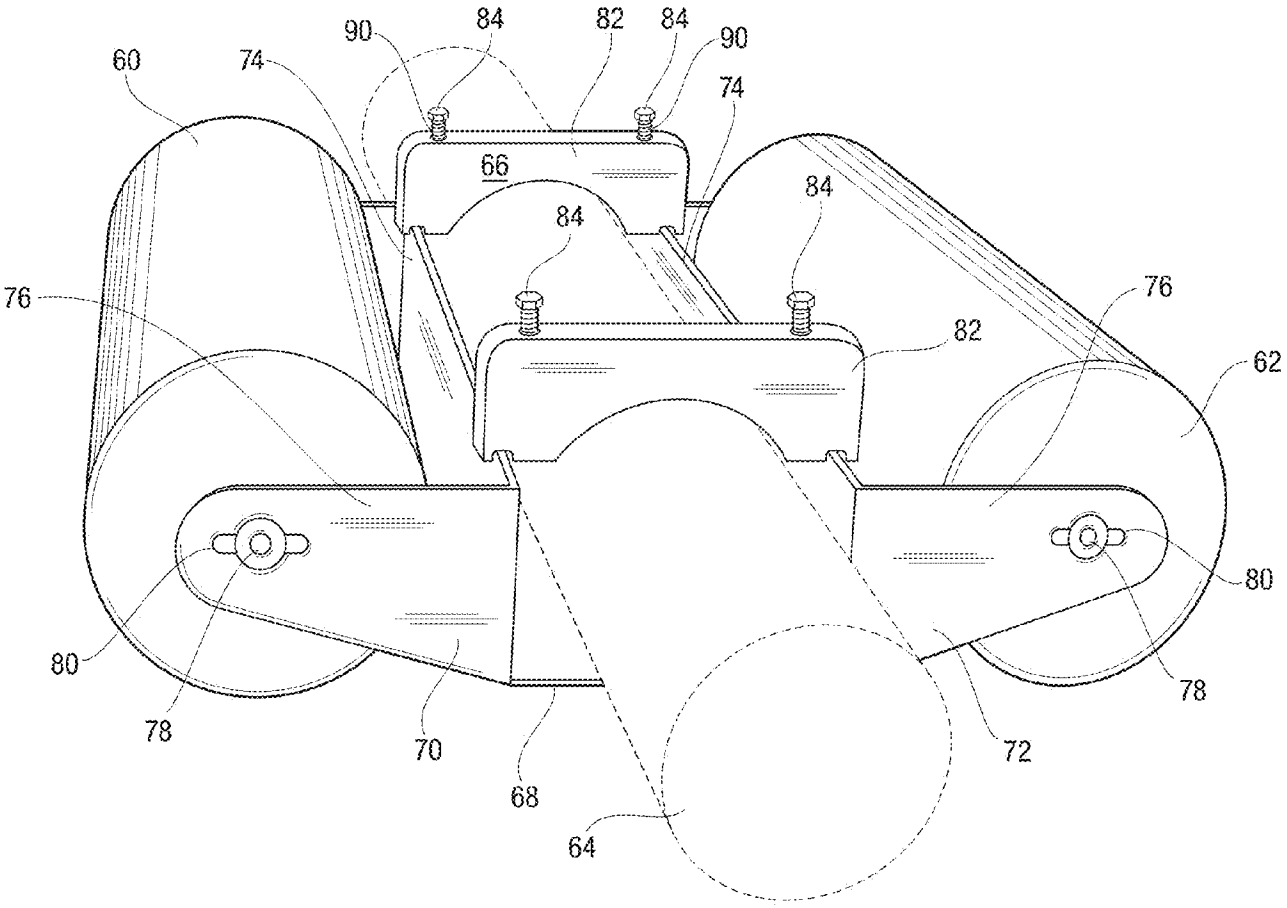
FIG. 9 is a perspective view of an additional embodiment of the invention.
Figure 10:
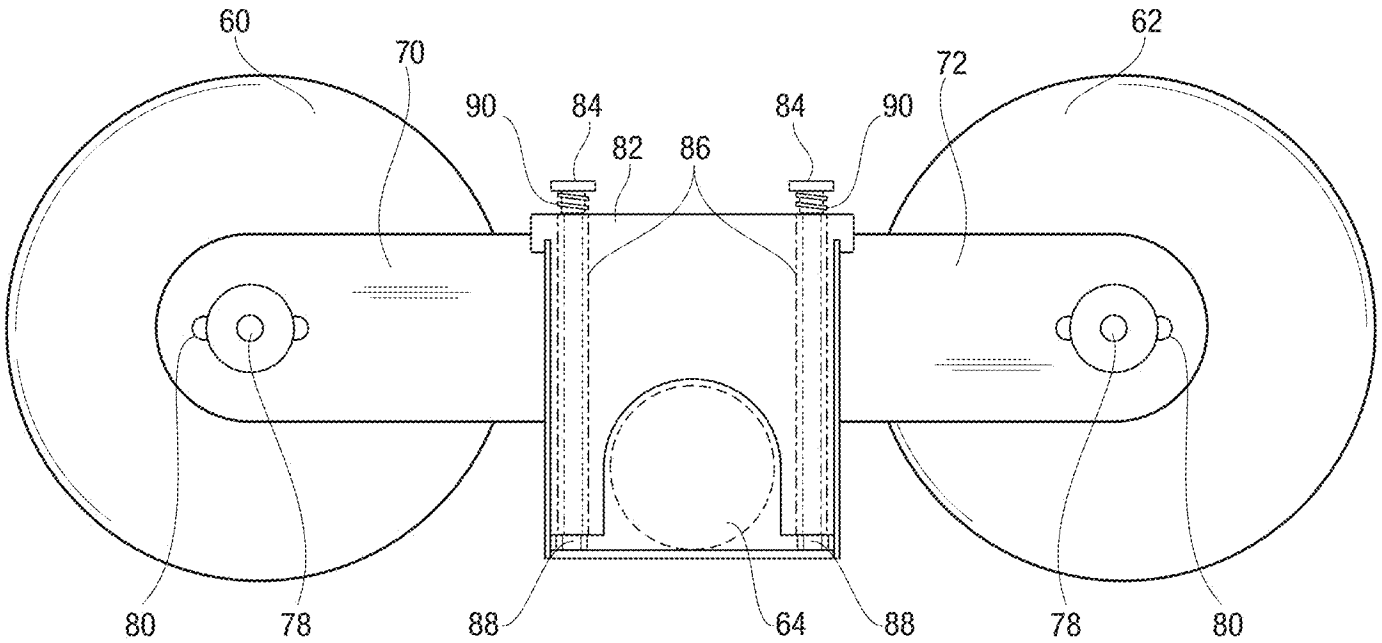
FIG. 10 is a side view of the embodiment of FIG. 1.

Referring next to FIGS. 9 and 10, an additional embodiment of the roller assembly described above is shown in which rollers 60 and 62 are attached to a goal rear ground crossbar 64 employing frame 66 consisting of a central bottom plate 68 joining two spaced apart front and rear roller mounting brackets 70 and 72. Each bracket is composed of a vertical longitudinal upright 74 and a pair of two side uprights 76 disposed one each at opposite ends of upright 74.

Each pair of uprights 76 provides a mounting support for a roller axel 78 longitudinally disposed substantially parallel to upright 74. Each axel 78 is slideably mounted between a matching pair of side uprights 76 in substantially horizontal slots 80 disposed therein and secured thereto by, for example, a combination of washers and a ROTORCLIP TX-50 shaft ring or similar device connected to each end of the axel as described above. Mounting of the axels in these horizontal slots will allow the rollers to swivel a limited amount when the goal is being repositioned imparting a degree of stearability to maneuver in tight spaces.

Further illustrated is an alternative means to attach the framework and rollers to ground rear crossbar 64 consisting of hold down brackets 82 positioned over crossbar 64 and secured in place by hexbolts 84 disposed in bolt housings or channels 86 in bracket 82 communicating with threads in bottom plate 68 or a nut 88 underneath or attached thereto. The bottom surface of bracket 82 may be shaped and size in any appropriate profile suitable for the goal crossbar to which the assembly is to be attached.

Coil springs 90 may be disposed between the bolt head and the top bracket surface to act as a piston and allow the brackets to partially release from the crossbar to rotate when the goal is lifted to facilitate relocation.

It has been found that over a period of time, the impact of soccer balls striking the above described goal as well as player collisions with the goal framework may result in the loosening of bolts 40 which secure the clamping members atop the goal crossbar.

As described below, alternative and improved clamping assemblies, through horizontal or perpendicular pressure, can be provided to reduce or eliminate any loosening of the roller-goal clamping arrangement shown above.

Figure 12:
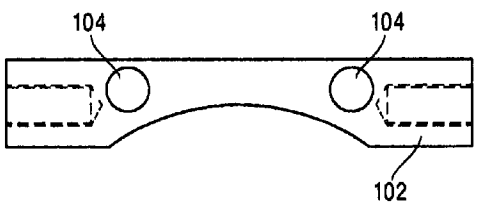
FIG. 12 is a side view of a component of FIG. 11.
Figure 11:
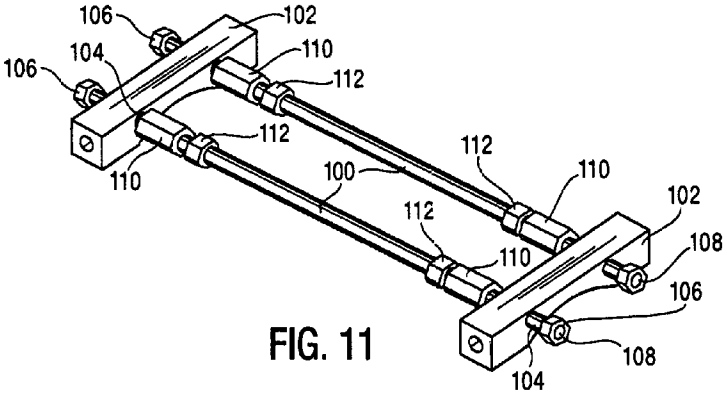
FIG. 11 is a perspective view of one embodiment of the improved clamping assembly of the invention.

In one embodiment as shown in FIGS. 11 and 12, an additional pair of end threaded rods 100 are disposed between clamping members 102 in ports 104. An end cap 106, a nut for example, is nonrotatably attached to each end 108 of each rod. Clamping nuts 110 are disposed on the inside portion of each rod such that when the clamping members are positioned at the proper height in, as shown in FIG. 1, slots 42, according to the diameter of the crossbar in use, tightening nuts 110 secures each of the clamping members 102 between cap 106 and clamping nut 110. Nuts 110 are then tightened as before creating a two dimensional perpendicular clamping force to resist the impacts the goal is subjected to during use. Additionally, lock or jam nuts 112 may be provided to further prevent nuts 110 from loosening.

Figure 13:
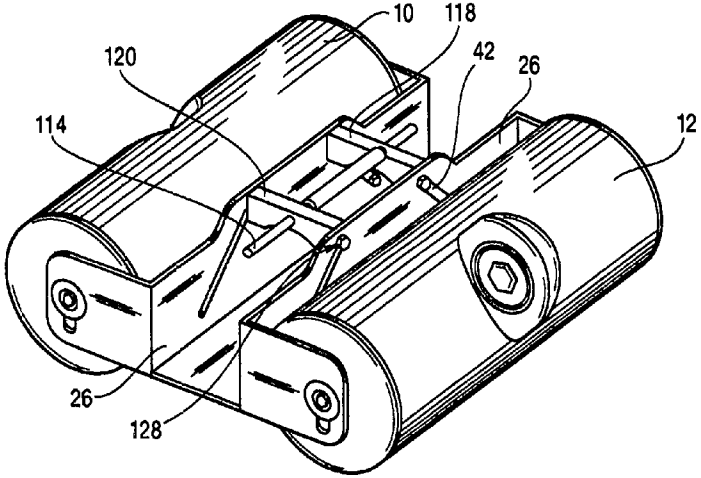
FIG. 13 is a perspective view of an additional embodiment of the improved clamping assembly of the invention.
Figure 14:
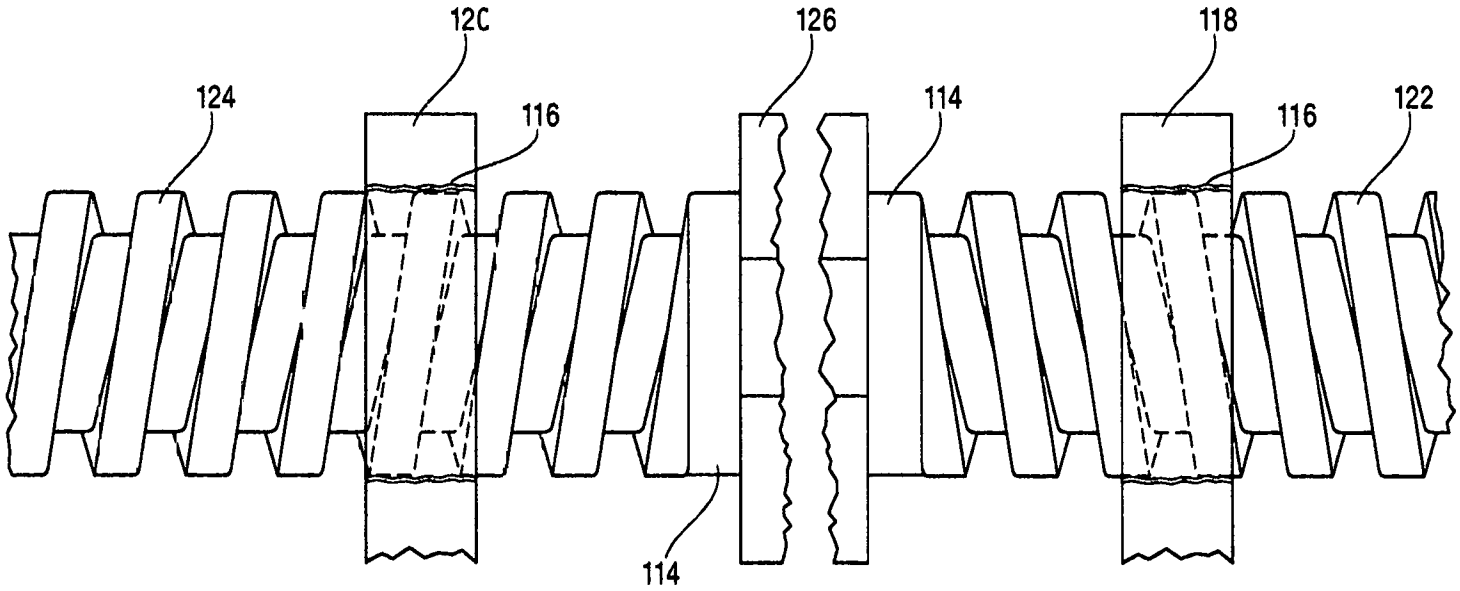
FIG. 14 is a side view of a component of FIG. 13.

An additional embodiment of the invention is illustrated in FIGS. 13 and 14 using a single shaft or rod employing counter rotating right and left handed threads engaging the clamping members to provide a perpendicular or horizontal force to spread them apart.

As shown, this clamping assembly, disposed in the roller assembly of FIG. 1, wherein like components are identified by like numbers, comprises a threaded rod 114 that passes through threaded ports 116 in clamping members 118 and 120 and includes right hand threads 122 at one end and left hand threads 124 at the opposite end.

Rod 114 when rotated by, for example, a central nut 126, exerts an outward or spreading force on clamping members 118 and 120 disposed in diagonal slots 42 using bolts or pins 128. This results in a downward clamping force on the crossbar by the clamping members binding the entire roller assembly and crossbar together with superior strength. In addition, it has been found that these bolts or pins need to serve a guide purpose only and are no longer required to provide an independent lateral binding force with frame members 26.

Variations in the above described preferred embodiments may be made within the general concept of the disclosure. The invention is therefore accordingly defined by the following claims.

What is claimed is:

1. A weighted roller apparatus for a ground disposed sports goal, said goal comprising a net supporting frame having at least two spaced apart side members joined at the rear by a nonrotatable ground crossbar and at the front by a top crossbar, said roller apparatus comprising in combination;

A. a framework attachable to said ground crossbar, said ground crossbar having a longitudinal axis;

B. a first weighted roller having a longitudinal axis and an outer surface, said roller rotatably attached to said framework forward of and spaced apart from said ground crossbar, the longitudinal axis of said first weighted roller arranged to be substantially parallel to that of said ground crossbar;

C. a second weighted roller having a longitudinal axis and an outer surface, said roller rotatably attached to said framework rearward of and spaced apart from said ground crossbar, the longitudinal axis of said second weighted roller arranged to be substantially parallel to that of said ground crossbar and said first weighted roller, the diameters of said surfaces of said first and second weighted rollers of sufficient size to raise said framework and said ground crossbar above said ground;

D. An axle supported by said framework for mounting each of said rollers;

said framework further comprising:

i. a bottom plate arranged to support said ground crossbar;

ii. a first weighted roller mounting bracket attached to said bottom plate and disposed forward of said ground crossbar; and iii. a second weighted roller mounting bracket attached to said bottom plate and disposed rearward of said ground crossbar;

each of said mounting brackets comprising:

iv. an upright member longitudinally attached to said bottom plate; and v. a pair of side members disposed one at each end of and extending outwardly from said bottom plate and said crossbar, said side members arranged to support said axles and said rollers;

each of said side members having a substantially vertical slot disposed therein, said slots longitudinally aligned with said crossbar and each other, said slots arranged to receive said axle, and wherein said axle is vertically slideably mounted within said slots between said side members;

said brackets and said bottom plate forming a cradle for receiving said crossbar;

E. said weighted roller apparatus further including clamping means for securing said crossbar to said bottom plate;

said clamping means comprising:

i. a pair of longitudinally opposed spaced apart clamping members perpendicularly and vertically slideably disposed between said upright members, said clamping members having an upper edge and a lower edge, said lower edge having a curved indented segment having a periphery at least as great as that of said crossbar to be disposed therein; and ii. securing means for securing said clamping members at a selected vertical height above said bottom plate wherein the upper surface of said crossbar is in contact with said curved indented segment, wherein each of said clamping members has a pin disposed in each opposing longitudinal edge, wherein each of said upright members has a spaced apart pair of diagonally opposed slots, each pair of said slots aligned with the other, each slot arranged to receive one of said pins for slideably mounting said clamping members, wherein each of clamping members has at least one threaded port disposed in the face thereof, and further including a threaded bar longitudinally disposed between said clamping members and within said ports, said bar having left hand oriented threads on one end and right hand oriented threads on the opposite end, whereby, upon the rotation of said bar, said clamping members will be driven apart from one another and downward in their respective slots forcing said ground crossbar against said bottom plate, whereby a clamping force is applied between said crossbar and said weighted roller apparatus to secure said apparatus to said crossbar at a selected longitudinal position along said crossbar.

* * * * *